United States Patent [19]

Kageyama et al.

[11] 4,200,977

[45] May 6, 1980

[54] CUTTER KNIFE

[75] Inventors: Toshihiko Kageyama; Hidehei Kageyama, both of Kawagoe, Japan

[73] Assignee: Kotobuki & Co. Ltd., Kyoto, Japan

[21] Appl. No.: 950,031

[22] Filed: Oct. 10, 1978

Related U.S. Application Data

[63] Continuation of Ser. No. 862,913, Dec. 21, 1977, abandoned.

[30] Foreign Application Priority Data

| | | | |
|---|---|---|---|
| Jan. 17, 1977 | [JP] | Japan | 52-4093 |
| Feb. 21, 1977 | [JP] | Japan | 52-19882 |
| Feb. 21, 1977 | [JP] | Japan | 52-19883 |
| Feb. 21, 1977 | [JP] | Japan | 52-19884 |

[51] Int. Cl.[2] ..... B26B 1/08

[52] U.S. Cl. ..... 30/162; 30/320

[58] Field of Search ..... 30/162, 320

[56] References Cited

U.S. PATENT DOCUMENTS

| | | | |
|---|---|---|---|
| 3,708,881 | 1/1973 | Bennett | 30/320 |
| 3,888,002 | 6/1975 | Graham | 30/162 |
| 4,012,836 | 3/1977 | Baer | 30/320 |
| 4,063,356 | 12/1977 | Hepworth | 30/162 |
| 4,089,112 | 5/1978 | Richards | 30/162 |

*Primary Examiner*—Jimmy C. Peters

*Attorney, Agent, or Firm*—Sherman & Shalloway

[57] ABSTRACT

A cutter knife comprising a band-shaped blade, a tubular holder for supporting said blade to make it movable in the axial direction thereof, an operating member for locating said blade at any desired position, and means for securing said operating member to any desired position with respect to said holder, said means including a series of engagement surfaces formed in said holder and located in a plane extending in a direction substantially perpendicular to the direction of movement of said operating member and a lug formed in said operating member and releasably engageable with one of said engagement surfaces.

5 Claims, 8 Drawing Figures

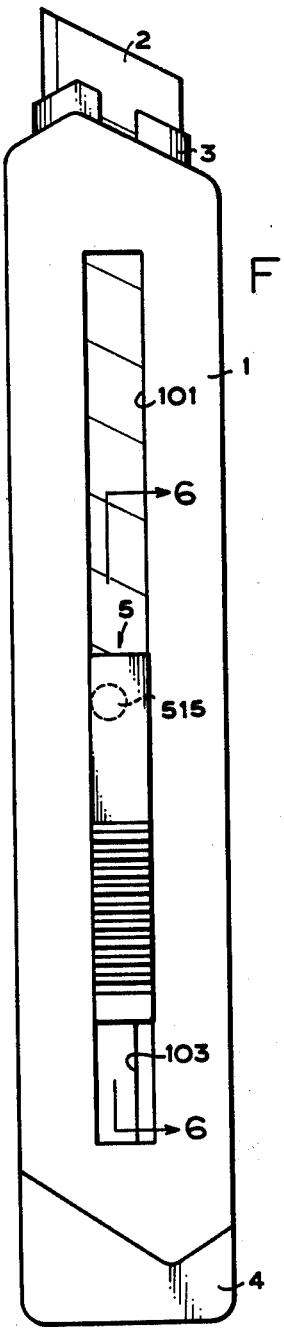
FIG. 5
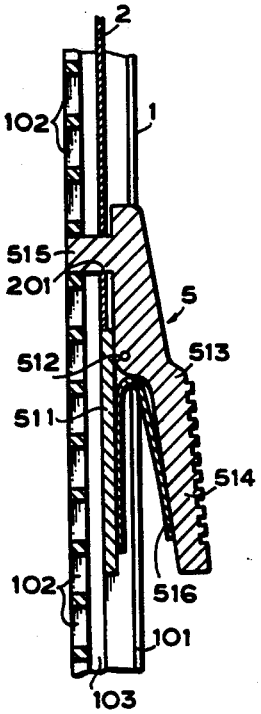
FIG. 6
FIG. 7
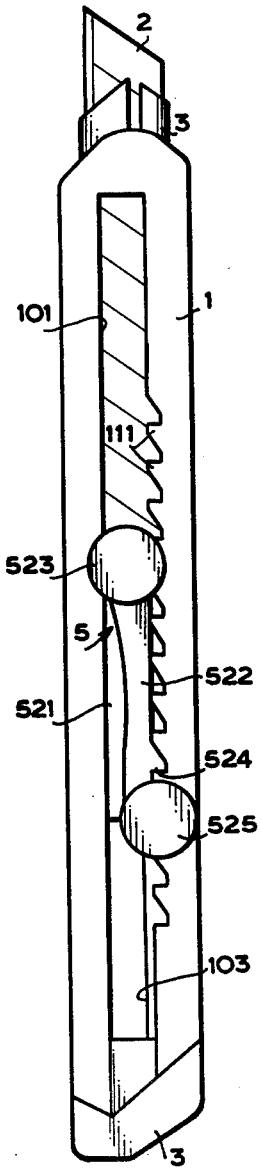
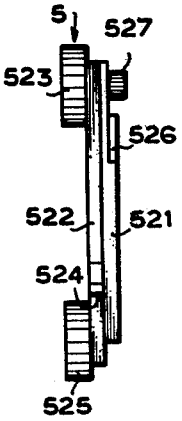
FIG. 8

CUTTER KNIFE

This is a continuation of application Ser. No. 862,913, filed Dec. 21, 1977 now abandoned.

BACKGROUND OF THE INVENTION

This invention relates to a cutter knife comprising a band-shaped blade and a holder for holding the blade and used under such condition that one portion of the blade is projected for a required length from the front end of the holder and that if the cutting ability of the used portion of the blade is reduced, the front end portion thereof is broken off and then the blade if forwardly moved so as to use the succeeding portion of the blade.

In such kind of cutter blade, if the cutting ability of the used portion of the blade is reduced, the front end thereof is broken off and then the succeeding portion is required to be forwardly moved for the purpose of projecting this portion from the front end of the holder. As a result, it is indispensable to provide a holder for holding the blade so as to make it movable in its lengthwise direction, an operating member movable together with the blade with respect to the holder and a mechanism for securing both the blade and the operating member at any desired position to the holder.

In such kind of cutter knife, it has been proposed to use a click mechanism. Such conventional click mechanism, however, has the disadvantage that there is a risk of the blade being carelessly rearwardly moved when the blade is subjected to the force acting in a direction which is in parallel with the direction of movement of the blade.

It has also been proposed to use a screw threadedly engaged with the operating member and the front end of the screw is urged against the holder so as to secure the operating member to the holder. Such cutter knife has the drawback that the holder is required to have a sufficiently large mechanical strength, so that the holder must be formed of metal only and hence the cost of the cutter knife becomes expensive.

SUMMARY OF THE INVENTION

A main object of the invention, therefore, is to provide a cutter knife which can prevent any undesirous backward movement of a blade in a positive manner.

Another object of the invention is to provide a cutter knife which can firmly connect an operating member to a holder without using material having a large mechanical strength as material for constructing both the operating member and the holder.

A further object of the invention is to provide a cutter knife which can manually effect engagement and disengagement between a holder and an operating member in an easy manner.

A still further object of the invention is to provide a cutter knife which can finely adjust that length of a blade which is projected from the front end of a holder.

In the present invention, an operating member is secured to a holder with the aid of a series of engagement surfaces formed in the holder and a lug provided in the operating member and engageable with any one of the engagement surfaces and disengageable therefrom. These engagement surfaces are located at a plane extending in a direction substantially perpendicular to the direction of movement of the operating member. As a result, even when an exterior force that tends to rearwardly move the operating member is exerted through the blade to the operating member, the operating member could not rearwardly be moved with respect to the holder, thereby preventing the rearward movement of the blade.

BRIEF DESCRIPTION OF THE DRAWINGS

FIG. 5 is a front elevational view showing another embodiment of a cutter knife according to the invention;

FIG. 6 is a cross sectional view taken on line 6—6 of FIG. 5;

FIG. 7 is a front elevational view showing a further embodiment of a cutter knife according to the invention; and FIG. 8 is a side elevational view showing an operating member used for the cutter knife shown in FIG. 7.

DETAILED DESCRIPTION OF THE INVENTION

Figure 1:
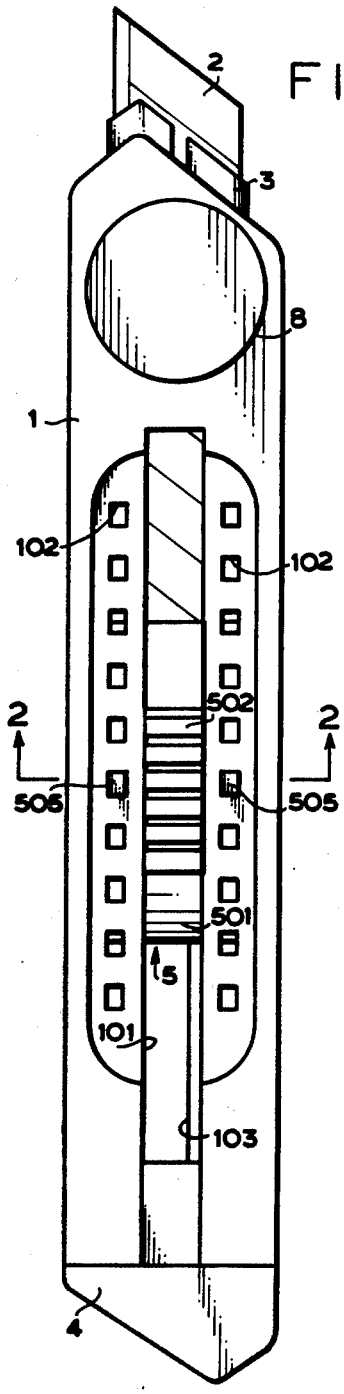
FIG. 1 is a front elevational view showing one embodiment of a cutter knife according to the invention.
Figure 2:
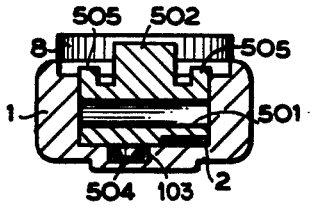
FIG. 2 is a cross sectional view taken on line 2—2 of FIG. 1.

Referring to FIGS. 1 and 2, reference numeral 1 designates a tubular holder which is substantially rectangular in section. The holder 1 is provided on one side surface with an elongated hole 101 extending in the axial direction of the holder 1. Each side of the elongated hole 101 has a plurality of engagement holes 102 equidistantly spaced apart from each other. Into the holder 1 is inserted a band-shaped blade 2 which is movable in the axial direction of the holder 1. The holder 1 is provided at its front end with a guide 3 for preventing the blade 2 from being displaced in directions other than the axial direction of the holder 1 and provided at its rear end with an end cap 4 detachably fitted to the holder 1.

Figure 3:
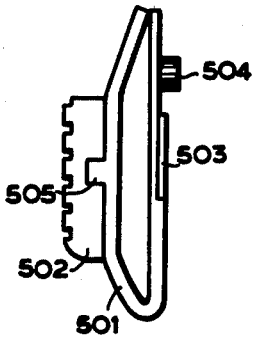
FIG. 3 is a side elevational view showing an operating member used for the cutter knife shown in FIG. 1.

In the elongated hole 101 of the holder 1 is located an operating member 5 for forwardly and rearwardly moving the blade 2 with respect to the holder 1. As shown in a side elevational view in FIG. 3 in detail, the operating member 5 is composed of a substantially V-shaped main body 501 having a suitable elasticity and a manually operating portion 502 mounted on the upper surface of the main body 501. The upper end of the manually operating portion 502 is extended through the elongated hole 101 of the holder 1 and projected therefrom. The main body 501 is provided at its lower surface with a notch 503 adapted to be engaged with the rear end of the blade 2 and with a projection 504 projected from the base surface of the notch 503 and extending through an aperture (not shown) formed in the blade 2. The projection 504 is brought into engagement with a groove 103 formed in the holder 1. As a result, the projection 504 functions to connect the blade 2 to the operating member 5.

The main body 501 is provided at its upper surface with a pair of engagement lugs 505, 505 arranged at each side of the manually operating portion 502. When these engagement lugs 505, 505 are projected into and engaged with the engagement holes 102, 102 provided in the holder 1, these engagement lugs 505, 505 function to prevent the movement of the operating member 5 with respect to the holder 1.

Figure 4:
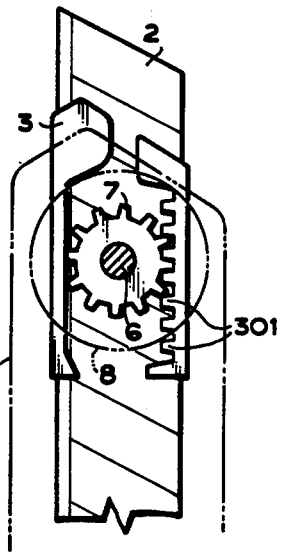
FIG. 4 is a front elevational view showing a guide and a driving mechanism thereof used for the cutter knife shown in FIG. 1.

As shown in FIG. 4, the guide 3 is carried by the front end of the holder 1 and formed of a channel-shaped metal plate having a passage through which the blade 2 is moved in its axial direction only. The guide 3 is made movable in the axial direction of the holder 1. The guide 3 is formed at one of opposed side surfaces thereof with a rack 301 which engages with a pinion 7 secured to one end of a shaft 6 journalled in the holder 1. The shaft 6 is provided at its another end with a knob 8 located at the outside of the holder 1.

In the cutter knife constructed as above described, if the manually operating portion 502 is pushed, the main body 501 is deformed by its own elasticity in a direction of which reduces its thickness to release the engagement lugs 505, 505 from the engagement holes 102, 102. If the engagement lugs 505, 505 are separated from the engagement holes 102, 102, the operating member 5 becomes movable in the axial direction of the holder 1. Since the blade 2 is connected to the operating member 5, the movement of the operating member 5 results in the movement of the blade 2, thus permitting the forward and rearward movement of the blade 2.

If the pushing force subjected to the manually operating member 502 is released at any position, the main body 501 is restored to its original configuration, and as a result, the engagement lugs 505, 505 are projected into and engaged with the engagement holes 102, 102, thereby locking against the operating member 5 to the holder 1.

If the engagement lugs 505, 505 are not aligned with the engagement holes 102, 102 when the pushing force subjected to the manually operating portion 502 is released at any position, the operating member 5 may slightly be moved in any direction so as to align the engagement lugs 505, 505 with the engagement holes 102, 102. Thus, it is possible to effect the above mentioned engagement between the engagement lugs and holes.

The wall surface of the engagement hole 102 provided in the holder 1 is located at a plane substantially perpendicularly to the axial direction of the holder, that is, to the direction of movement of both the operating member 5 and the blade 2. The engagement lugs 505 are only movable in a direction in parallel with the wall surface of the engagement hole 102. As a result, when the front end of the blade 2 is strongly urged against a work piece and hence is pushed rearwardly into the holder 1, the operating member 5 not be moved the holder 1. Thus, there is no risk of the blade 2 being moved rearwardly.

The blade 2 is secured to the holder 1 at minimum intervals each of which is equal to the distance between two adjacent engagement holes 102, 102 in the axial direction of the holder 1, so that that length of the blade 2 which is projected beyond the front end of the guide 3 may be made equal to a value obtained by adding together a certain value and a value corresponding to integer times the distance between the two adjacent engagement holes 102, 102 in the axial direction of the holder 1.

That length of the blade 2 which is projected beyond the front end of the guide 3 may finely be adjusted by rotating the knob 8 provided at the front end of the holder 1, if desired.

When the front end of the blade 2 is projected beyond the front end of the guide 3 by a suitable length, if the knob 8 is rotated in a clockwise direction in FIG. 4, for example, the pinion 7 is also rotated through the shaft 6 in the same direction and hence the rack 301 engaged with the pinion 7 causing the guide 3 to move rearwardly. If the knob 8 is rotated in the opposite direction, the guide 3 is moved forwardly.

The blade 2 is moved with respect to the holder 1 in a stepwise manner at intervals each of which is equal to the distance between the two adjacent engagement holes 102, 102 in the axial direction of the holder 1, but the guide 3 is moved with respect to the holder in a continuous manner. As a result, that length of the blade 2 which is projected beyond the front end of the guide may finely be adjusted by rotating the knob 8 to any angular position in an easy manner. Thus, in a working operation such as a cutting operation an incision whose length is equal to the projection length of the blade 2 can easily be effected. In addition, the blade 2 may positively be secured to a plurality of positions of the holder 1 which have been predetermined, so that there is no risk of the blade 2 being rearwardly moved by accident. Thus, the operation of the cutter knife is safe in operation. p In FIGS. 5 and 6 is shown another embodiment of the cutter knife according to the invention. In FIGS. 5 and 6, the same or corresponding parts of the cutter knife shown in FIGS. 1 to 4 are designated by the same or corresponding reference numerals. In the present embodiment, the series of engagement holes 102 shown in FIG. 1 are not arranged at that wall of the holder 1 which is provided with the elongated hole 101, but are arranged at that well of the holder 1 which is opposed to the above mentioned wall. The operating member 5 is composed of a plate-shaped substrate 511 mounted in the elongated hole 101 of the holder 1 and movable in the axial direction of the holder 1 and a rotatable member 513 pivoted through a pin 512 to the substrate 511. The rotatable member 513 is provided at its one end with a push portion 514 projecting outwardly through the elongated hole 101 and at its another end with a column-shaped lug 515. The column-shaped lug 515 is projected through an opening 201 formed at the rear end of the blade 2 into the engagement hole 102 formed in the holder 1. A manually operating member 513 is subjected to the action of a leaf spring 516 and rotated in a direction such that the lug 515 is projected into the engagement hole 102.

If the push portion 514 is pushed, the rotary member 513 is rotated against the action of the leaf spring 516 to move the lug 515 in a direction such that the lug 515 is separated from the engagement hole 102. As a result, the operating member 5 is brought into such condition that the operating member 5 is movable in the axial direction of the holder 1. Under this condition, the lug 515 is located in the opening 201 formed in the blade 2, so that the movement of the operating member 5 results in the movement of the blade 2. As a result, it is possible to forwardly and rearwardly move the blade 2.

If the pushing force subjected to the push portion 514 is released, the reaf spring 516 functions to restore the rotatable member 513 to its original position and project the lug 515 into the engagement hole 102, thereby locking both the operating member 5 and the blade 2 to the holder 1.

Under the condition in which the lug 515 is projected into the engagement hole 102, the blade 2 is secured through the lug 515 to the holder 1. As a result, the force for forwardly and rearwardly moving the blade 2 is subjected thereto in a direction which is substantially perpendicular to the direction of the force required for separating the lug 515 from the engagement hole 102. Thus, if the operating member 5 inclusive of the lug 515 has a certain mechanical strength and hardness, there is no risk of the blade 2 being carelessly moved. Thus, the cutter knife according to the present embodiment is safe in operation. If the blade 2 is required to be forwardly and rearwardly moved, the push portion 514 is pushed and then it is possible to forwardly and rearwardly move the blade 2. As a result, the blade 2 can be moved in an extremely easy manner. In the present embodiment, the rotatable member 513 was pivoted through the pin 512 to the substrate 511. The invention is not limited to such construction. Any other constructions in which the lug 515 is separated from the engagement hole 102 when the push portion 514 is pushed are possible. In addition, both the holder 1 and the operating member 5 may be formed of material without having a large rigidity, for example, plastic material. In this case, the cost of the cutter knife can significantly be reduced.

In FIGS. 7 and 8 is shown a further embodiment of the cutter knife according to the invention. In the present embodiment, the elongated hole 101 extending in the axial direction of the holder 1 is provided at one of opposed side walls with a series of teeth, that is, a series of engatement lugs 111. Each of these engagement lugs 111 is of sawtooth shaped projection whose front edge is raised in a direction substantially perpendicular to the axial direction of the holder 1 and whose rear edge is inclined at an acute angle to the axial direction of the holder 1. The operating member 5 is composed of a substantially rectangular main body 521 movable in the axial direction of the holder 1, an engagement member 522 mounted on the upper surface of the main body 521 and a disc-shaped knob 523 secured to the front end of the engagement member 522. The knob 523 is located at the outside of the holder 1. The engagement member 522 is composed of an elastic deformable elongated bar and firmly secured at its front end to the main body 521. The engagement member 522 is provided with an engagement pawl 524 that tends to project into an indentation formed between two adjacent engagement lugs 111, 111 when the engagement member 522 is not subjected to an exterior force. The engagement member 522 is provided at its free end with a knob 525. When the knob 525 is pushed, the engagement member 522 is resiliently deformed to separate the engagement pawl 524 from the indentation formed between the two adjacent engagement lugs 111, 111.

Both the front edge of the engagement lug 111 and the rear edge of the engagement pawl 524 are located at a plane extending in a direction substantially perpendicular to the axial direction of the holder 1, that is, the direction of movement of the blade 2 and the operating member 5, so that if the engagement pawl 524 engages with the engagement lug 111, the operating member 5 could not be rearwardly moved with respect to the holder 1.

The main body 521 is provided at its lower surface with a notch 526 adapted to be engaged with the rear end of the blade 2 and with a pin 527 projected through an opening (not shown) formed in the blade 2 into the groove 103 formed in the holder 1, thereby connecting the blade 2 to the operating member 5.

In the cutter knife constructed in accordance with the present embodiment as described above, if the knob 523 is pushed forwardly, the engagement pawl 524 rides over the forwardly inclined rear edge of the engagement lug, and as a result, the operating member 5 is forwardly moved with a click sound uttered. If the force for rearwardly moving the blade 2 is subjected thereto, the engagement pawl 524 is urged against the front edge of the engagement lug 111 extending substantially perpendicular to the axial direction of the holder 1, thereby preventing the operating member 5 from being rearwardly moved with respect to the holder 1.

If it is desired to rearwardly move the blade 2, the knob 525 is pushed to separate the engagement pawl 524 from the indentation formed between the two adjacent lugs 111, 111. As a result, the operating member 5 is disengaged from the holder 1, so that both the operating member 5 and the blade 2 can be moved in the rearward direction thereof.

As seen from the above, even if the blade 2 is subjected to the force that tends to rearwardly move it, the blade 2 could not be moved rearwardly. But, if the knob 525 is pushed, it is possible to rearwardly move the blade 2 in an easy manner. Thus, the cutter knife according to the present embodiment is also significantly convenient and safe in oeration.

In the present embodiment described above, the holder 1 was provided at one side only of the elongated hole 101 with the engagement lugs 111. These engagement lugs 111 may be arranged at both the opposed sides of the elongated hole 101 and provision may be made of two engagement members 522 corresponding to these two engagement lugs 111. In this case, the operating member 5 may more positively be interlocked with the holder 1. If the rear end of the engagement member 522 is extended beyond the rear end of the main body 521 and this extended portion is projected into the elongated hole 101 provided in the holder 1, there is no risk of the rear end of the engagement member 522 being upwardly moved out of the elongated hole 101.

In the first embodiment of this invention as set forth above, the engagement holes 102 are through holes as shown in FIGS. 1 and 2, but these holes 102 may be replaced by recesses formed on the inner surface of the holder 1.

There will now be obvious to those skilled in the art many modifications and variations of the above described structure. These modifications and variations will not depart from the scope of the invention if defined by the following claims.

What is claimed is:

1. A cutter knife comprising:

(a) a band-shaped blade with an opening at the rear end thereof;

(b) a flat tubular holder with front and rear planar sides for holding said blade between said sides so as to make it movable in an axial direction of said holder, said holder being provided with an axial elongated hole in the front side thereof and with a plurality of engaging surfaces disposed along the axial direction on the rear side thereof and in alignment with the axial elongated hole, and (c) an operating member disposed in the axial elongated hole including a manually operating portion for operating a lug penetrating from the front side of the holder through said opening in said blade and selectively engaging one of said engaging surfaces.

2. The cutter knife according to claim 1 wherein the axis of the opening in the blade is parallel to the axis of the engaging surfaces and wherein the lug is movable along the axis of the opening of the blade.

3. The cutter knife according to claim 2 wherein the engaging surfaces are comprised of a plurality of square apertures in the rear side of the flat tubular holder and located along the axis of the elongated hole in the front side of the tubular holder; and wherein said lug has a square cross-section corresponding to the square apertures.

4. The cutter knife according to claim 2, wherein said operating member comprises a substrate movable along the axial direction of and located within said holder and a rotatable member located within the axial elongated hole rotatably supported on said substrate and provided with said operating portion at one end thereof and said lug at the other end thereof.

5. The cutter knife according to claim 4, wherein a biasing means is connected between said substrate and said rotatable member for urging said rotatable member to rotate so that said lug is held in a position of engagement with said engaging surface.

* * * * *